US005857882A

United States Patent [19]

Pam et al.

[11] Patent Number: 5,857,882

[45] Date of Patent: Jan. 12, 1999

[54] PROCESSING OF MATERIALS FOR UNIFORM FIELD EMISSION

[75] Inventors: Lawrence S. Pam, Pleasanton; Thomas E. Felter; Alec Talin, both of Livermore; Douglas Ohlberg, Mountain View; Ciaran Fox, Stanford, all of Calif.; Sung Han, Pojoaque, N. Mex.

[73] Assignee: Sandia Corporation

[21] Appl. No.: 607,532

[22] Filed: Feb. 27, 1996

[51] Int. Cl.[6] ..... H01J 9/44

[52] U.S. Cl. ..... 445/6; 445/51; 427/540

[58] Field of Search ..... 445/6, 51; 427/540

[56] References Cited

U.S. PATENT DOCUMENTS

| | | | |
|---|---|---|---|
| 3,665,241 | 5/1972 | Spindt et al. | 313/351 |
| 3,755,704 | 8/1973 | Spindt et al. | 313/309 |
| 3,789,471 | 2/1974 | Spindt et al. . | |
| 3,812,559 | 5/1974 | Spindt et al. . | |
| 5,064,396 | 11/1991 | Spindt | 445/50 |
| 5,141,460 | 8/1992 | Jaskie et al. | 445/24 |
| 5,199,918 | 4/1993 | Kumar et al. | 445/50 |
| 5,209,687 | 5/1993 | Konishi | 445/6 |
| 5,258,685 | 11/1993 | Jaskie et al. | 313/309 |
| 5,341,063 | 8/1994 | Kumar | 313/309 |
| 5,399,238 | 3/1995 | Kumar | 445/51 |
| 5,449,970 | 9/1995 | Kumar et al. | 313/495 |
| 5,470,265 | 11/1995 | Nomura et al. | 445/51 |
| 5,588,893 | 12/1996 | Kaftanov | 445/6 |
| 5,591,061 | 1/1997 | Ikeda et al. | 445/6 |

FOREIGN PATENT DOCUMENTS

| | | | |
|---|---|---|---|
| 6-89657 | 3/1994 | Japan | 445/51 |

OTHER PUBLICATIONS

Zhu, W. et al. Applied Physics Letter: vol. 67 (8):pp. 1157–1159 (Aug. 21, 1995) "Electron field emission from ion–implanted diamond".

Geis. M.W. et al. IEEE Electron Device Letters: vol. 12 (8):pp. 456–459 (Aug. 1991) "Diamond Cold Cathode".

Xu. N.S. and R.V. Latham Journal of Physics D: Applied Physics: vol. 26:pp. 1776–1780 (1993) "Similarities in the cold electron emission characteristics of diamond coated molybdenum electrodes and polished bulk graphite surfaces".

*Primary Examiner*—P. Austin Bradley
*Assistant Examiner*—Jeffrey T. Knapp
*Attorney, Agent, or Firm*—Timothy P. Evans

[57] ABSTRACT

This method produces a field emitter material having a uniform electron emitting surface and a low turn-on voltage. Field emitter materials having uniform electron emitting surfaces as large as 1 square meter and turn-on voltages as low as 16V/$\mu$m can be produced from films of electron emitting materials such as polycrystalline diamond, diamond-like carbon, graphite and amorphous carbon by the method of the present invention. The process involves conditioning the surface of a field emitter material by applying an electric field to the surface, preferably by scanning the surface of the field emitter material with an electrode maintained at a fixed distance of at least 3 $\mu$m above the surface of the field emitter material and at a voltage of at least 500V. In order to enhance the uniformity of electron emission the step of conditioning can be preceeded by ion implanting carbon, nitrogen, argon, oxygen or hydrogen into the surface layers of the field emitter material.

20 Claims, 1 Drawing Sheet

PROCESSING OF MATERIALS FOR UNIFORM FIELD EMISSION

STATEMENT OF GOVERNMENT INTEREST

This invention was made with Government support under contract no. DE-AC04-94AL85000 awarded by the U.S. Department of Energy to Sandia Corporation. The Government has certain rights in the invention.

BACKGROUND OF THE INVENTION

This invention pertains generally to field emitter flat panel displays and particularly to a method for improving the emission properties of field emitter materials.

Field emitter materials are useful whenever a source of electrons is needed, in particular, for applications such as vacuum microelectronics, electron microscopy and flat panel displays. Flat panel displays which use field emission (cold cathode emission) have several potential advantages over other types of flat panel displays, including low power consumption, high intensity, low projected cost, low turn-on voltage, high site density (>100/pixel) as well as being more stable and robust. For these reasons, field emission displays have the potential to be a low cost, high performance alternative to cathode ray and liquid crystal display technologies. As discussed in W. Zhu et al., *Electron Field Emission from Ion-implanted Diamond,* Appl. Phys. Lett., 67(8), 21 Aug. 1995, one of the key issues in producing commercially viable field emitters is the development of reliable and efficient field emitter (cold cathode) materials for these devices. At the present time, field emitter materials typically require either complicated fabrication steps or high control voltages to promote emission or both. Furthermore, field emitter materials have several limitations which restrict their usefulness. One limitation concerns the energy imparted to the electrons after they are emitted. Another limitation concerns the uniformity of emission current over the surface of the field emitter material.

The energy which the electric field imparts to electrons after emission can reach a level such that gases surrounding the electron emitter are ionized by the high energy electrons. These ionized gases can, in turn, damage the field emission surface and thereby impair further emission. To reduce the magnitude of the electric field required for electron emission, low work function materials can be used (i.e., special materials that emit electrons at relatively low energy levels) or the emitting surface of the material can be shaped such that the field is concentrated into a small region.

The shape of a field emitter material can affect its emission characteristics. Field emission is most easily obtained from electrically conducting sharply pointed needles or tips. The basic technology useful for fabricating field-imaging structures having this feature has been described by Spindt in U.S. Pat. Nos. 3,812,559, 3,665,241, 3,755,704, 3,789,471 and 5,064,396. Fabrication of these electrically conducting sharply pointed needles or tips requires extensive and elaborate processing steps as well as expensive facilities. It is difficult to perform fine feature lithography on the large areas demanded by flat panel display type applications. Thus there is a need for a method of making flat panel displays using field emitter materials that does not require the complicated and expensive fabrication steps employed to produce the specialized field enhancing shapes (sharply pointed needles or tips) characteristic of "Spindt arrays".

Zhu et al. ibid. have recently shown that diamond possesses properties that make it a desirable material for field emitters. However, little is known about the mechanisms responsible for electron emission from undoped or p-type doped diamond, except that there appears to be a strong correlation between defect densities and emission properties. Geis et al. *Diamond Cold Cathode,* IEEE Electron Device Letters, 12, 456–459 (1991) report the fabrication and characterization of carbon-implanted diamond materials having current densitites ≈0.1 to 1 A/cm$^2$ which compares favorably with silicon cold cathodes. Xu et al. *Similarities in the "Cold" Electron Emission Characteristics of Diamond Coated Molybdenum Electrodes and Polished Bulk Graphite Surfaces,* J. Phys. D: Applied Phys. 26, 1776–1780 (1993) have shown that substantial electron emission can be obtained at fields as low as 5 V/$\mu$m for a graphite-rich diamond film and a diamond-rich graphite electrode. However, while the turn-on voltage (i.e., the minimum voltage required to cause electron emission) for these diamond materials is low, the electron emission is not uniform over the surface but instead appears to arise from isolated sites on the surface of the graphite-rich diamond film. What is needed is an electron emitting material that has a low turn-on voltage wherein the electron emission is uniform across the emitter material surface and wherein the density of electron emission sites is increased.

Responsive to these needs, the present invention provides a method for creating a electron emitter material having a high uniformity of electron emission, a high density of electron emission sites and a low turn-on voltage.

SUMMARY OF THE INVENTION

The present invention discloses a novel method for producing an improved field emitter material by step of conditioning the surface of a diamond or diamond-like material. The step of conditioning the lowers the turn-on voltage, increases the density of electron emission sites and improves the uniformity of electron emission from these materials. The step of conditioning comprises applying an electric field to the surface of the field emitter material, wherein an electrode is positioned above the surface of the field emitter material and a positive voltage is applied between the electrode and the field emitter material. The electrode can be maintained at a constant distance of about 10 $\mu$m above the surface with a constant positive voltage of about 1500 V applied between the electrode and the surface of the field emitter material. The distance of the electrode, which can be a metal plate or, preferably a metal tip, above the surface of the field emitter material can be held steady at a constant distance wherein this constant distance can take a value in the range of 3–100 $\mu$m and the voltage can be held constant wherein this constant voltage can take a value in the range of 500–5000 V. A current limiting device, such as a resistor, can be included in the circuit. It is preferable that the surface of the field emitter material be ion implanted, cleaned and annealed prior to the step of conditioning The inventors have determined that a field emitter material having a highly uniform electron emitting surface as large as 1 square meter and a turn-on voltage as low as 16 V/$\mu$m can be prepared from electron emitting materials, such as a polycrystalline diamond film by:

a) implanting carbon ions into the surface of the polycrystalline diamond film, b) conditioning the diamond film surface by scanning a metal tip over the diamond film surface.

DETAILED DESCRIPTION OF THE INVENTION

Figure 1:
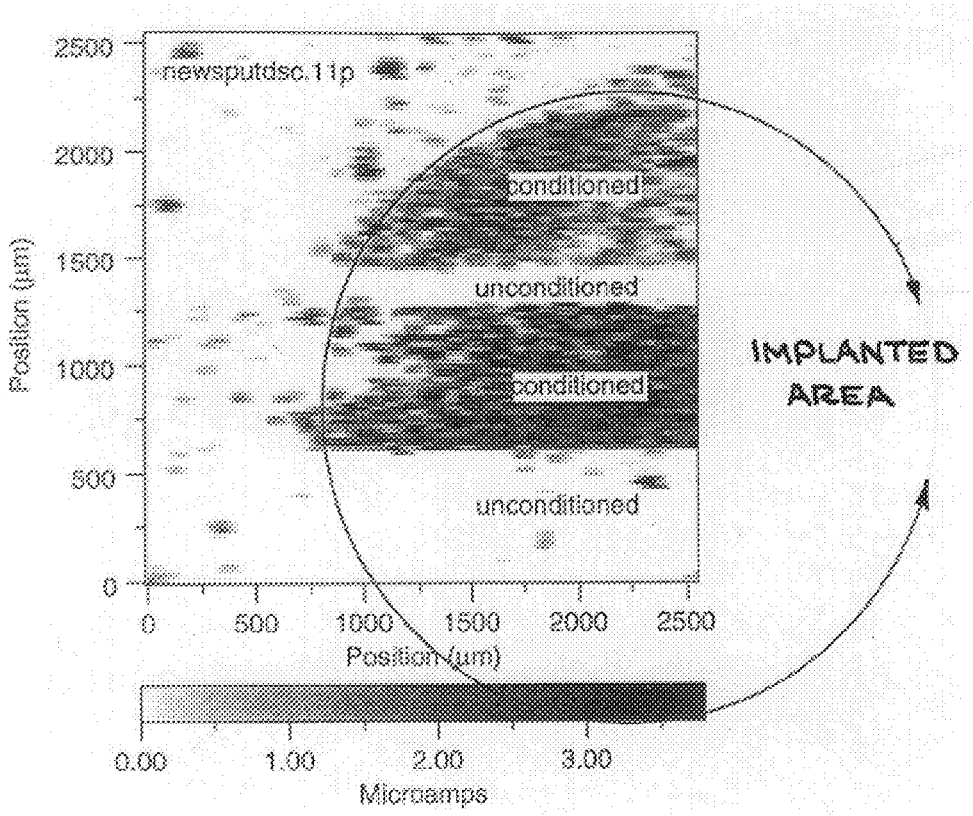
FIG. 1 is an emission map of a carbon implanted diamond surface showing the conditioned and unconditioned regions on the surface.

The present invention provides a method for producing an improved field emitter material having a uniform electron emitting surface.

To better appreciate the present invention, the following introductory comments are provided. Electron emission from a material occurs whenever electrons are able to either cross a potential energy barrier or tunnel through it, in accordance with the probabilities of quantum mechanics. The requisite energy for crossing the potential energy barrier can be supplied by several means. Thermionic or photoelectric electron emission can occur whenever sufficient energy in the form of electromagnetic radiation, long wavelength (heat) in the case of thermionic electron emission and higher wavelength (light) in the case of photoelectron emission, is provided to electrons to permit them to be spontaneously emitted. Secondary emission of electrons can occur, for example, by bombardment of a substance with charged particles such as electrons or ions. Field emission or cold cathode emission occurs under the influence of a strong electric field.

The theory of field emission is well developed; see, for example, A. J. Dekker, *Solid State Physics,* Prentice Hall (1957) p. 227. Field emission is a quantum mechanical effect wherein a strong external electric field, on the order of $10^6$ V/cm or greater, alters the potential energy barrier at a conductive emission surface to the extent that electrons are able to tunnel through the potential energy barrier rather than surmount it as in the case of thermionic or photoelectric electron emission. While it is theoretically possible to extract current densities of several million amps/cm$^2$ by field emission, in contrast to other means of electron emission, the actual currents that can be drawn from field emitter materials are strongly dependent upon the crystallographic orientation as well as the condition of the surface namely, cleanliness and the presence or absence of defects in the surface.

It is known in the art that ion implantation can lower the threshold voltage for electron emission for certain materials such as diamond or diamond-like carbon. What has been discovered herein is a method whereby the uniformity of electron emission from field emitter materials such as diamond or diamond-like carbon can by improved by conditioning the surface of field emitter material. It has been further discovered herein that it is preferable for ion implantation to occur prior to the conditioning step such that a more uniform field emitting surface can be produced. As will be discussed more fully below, the step of conditioning comprises applying an electric field to the surface of a field emitter material, preferably by scanning a metal electrode over the surface of the field emitter material wherein the metal electrode is preferably maintained at a distance of about 10 $\mu$m above the surface and at a positive voltage of about 1500 V, with respect to the field emitter material surface.

The present invention can be characterized by the following steps:

a) A film, preferably a polycrystalline diamond film, can be deposited onto a substrate, preferably a silicon wafer, by processes well known in the art, such as microwave plasma-assisted chemical vapor deposition. The microwave plasma-assisted chemical vapor deposition process can be controlled such that a nucleation layer having a high number density of areas where crystal nucleation can take place (i.e. a high density of nucleation sites) is produced on the substrate. The high density of nucleation sites can be produced by applying a bias voltage of from about −200 to −300 V to the substrate during the initial growth phase. It is preferred that a film about 1 to 2 $\mu$m thick containing ≈200 nm crystallites be prepared. Useful films can also be prepared from other materials, such as large-grain polycrystalline diamond, single crystal diamond, diamond-like carbon, graphite and amorphous carbon.

b) The film can be implanted with ions, using an ion implanter, to concentrations which can range from $10^{13}$ to $10^{16}$ ions/cm$^2$. It is preferred that the film be implanted with carbon ions having an energy of about 32 keV, at room temperature, at a nominal beam current of at least about 40 $\mu$A and preferably about 80 $\mu$A. However, other ions can be used for implanting, such as nitrogen, argon, oxygen and hydrogen.

c) The implanted film can be cleaned to remove debris produced by the ion implantation step.

d) The ion implanted and cleaned film can be annealed by heating, preferrably in a vacuum for about an hour at a temperature of less than about 350° C.

e) The ion implanted, cleaned and annealed film is then conditioned by scanning a metal electrode, preferably a tungsten tip, over the surface of the ion implanted film; the metal electrode being maintained at a distance of at least about 3 $\mu$m and preferably about 10 $\mu$m above the surface and at a positive voltage of at least about 500 V and preferably about 1500 V, with respect to the ion implanted film surface. Scanning can be done by moving the electrode in increments, in both the "x" and "y" directions, over the surface of the film being conditioned. The step size of the increments can be changed, but a step size of 20 $\mu$m is preferred, such that a scan line density of about 1 line/20 $\mu$m is produced.

Referring now to FIG. 1 which is a map of the electron emission from a carbon ion implanted (≈$5\times10^{16}$ ions/cm$^2$) diamond film which contained both conditioned and unconditioned regions as well as ion implanted and unimplated regions. The circle superimposed on FIG. 1 shows that area of the sample which had been ion implanted with carbon ions, as described above. Conditioned regions appear as horizontal bands across the imaged area as marked in FIG. 1. It can be seen that:

1) only those regions which had been conditioned by the process set forth above are electron emitting (the horizontal band between 1250–1500 $\mu$m is not conditioned).

2) those conditioned areas which had been ion implanted prior to the conditioning step are shown to be more highly and more uniformly electron emitting than conditioned areas that have not been ion implanted.

Figure 2:
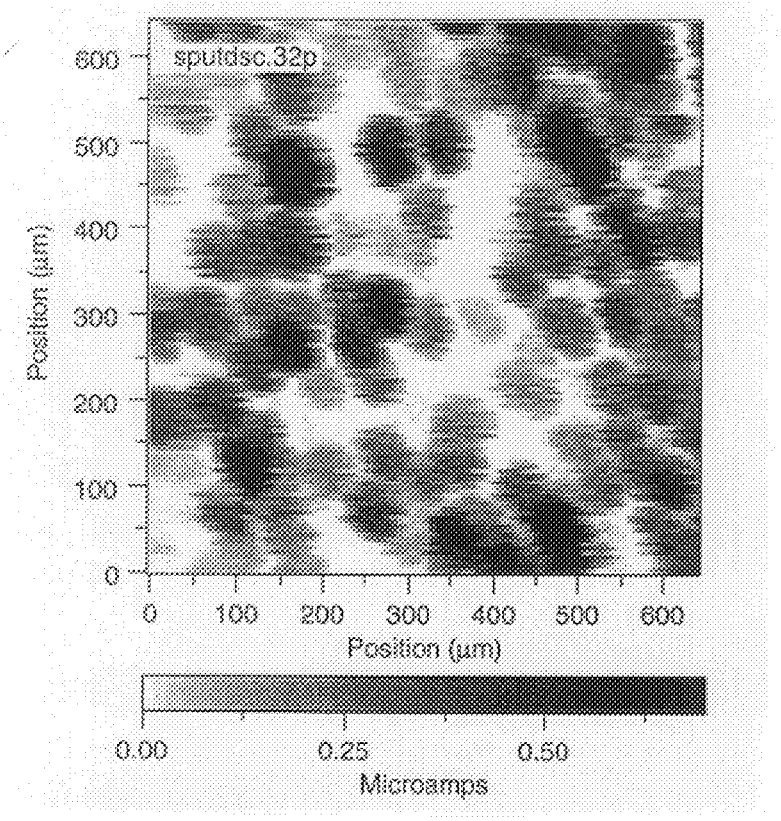
FIG. 2 is a higher resolution map of a conditioned, carbon implanted diamond surface.

FIG. 2 is a higher resolution scan of an implanted and conditioned area of the sample shown in FIG. 1. This figure shows a high emission site density equal to approximately 200/mm$^2$.

From the foregoing description, one skilled in the art can readily ascertain the essential characteristics of the present invention. The description is intended to be illustrative of the present invention and is not to be construed as a limitation or restriction thereon, the invention being delineated in the following claims.

We claim:

1. A method for creating field emitter materials having a substantially uniform electron emitting surface by the step of applying an electric field to the surface of an ion implanted field emitter material.

2. The method of claim 1, wherein said field emitter material produced has a turn-on voltage of at least 16 V/$\mu$m.

3. A method for improving the uniformity of electron emission and lowering the turn-on voltage of a field emitter material, comprising the step of conditioning said field emitter material by applying an electric field to a surface of a film of said field emitter material.

4. The method of claim 3, wherein the field emitter material is selected from the group consisting of polycrystalline diamond, single crystal diamond, diamond-like carbon, graphite and amorphous carbon.

5. The method of claim 3, wherein the electric field is applied between an electrode maintained at a fixed distance above said field emitter material surface and wherein a voltage is applied between said electrode and said field emitter material surface wherein said electrode voltage is biased positive with respect to said field emitter material surface.

6. The method of claim 5, wherein the electrode includes a metal tip.

7. The method of claim 5, wherein the fixed distance is a distance of at least about 3 $\mu$m above the surface of the field emitter material.

8. The method of claim 5, wherein the voltage is at least 500 volts.

9. The method of claim 3, further including a step of ion implantion prior to the step of conditioning, whereby ions are implanted into the field emitter material.

10. The method of claim 9, wherein the implanted ions are selected from a group consisting of carbon, nitrogen, argon, oxygen, and hydrogen and combinations thereof.

11. The method of claim 10, wherein the ions are implanted into a surface of the field emitter material at a current of at least 40 microamps to a concentration of at least $10^{16}/cm^2$.

12. The method of claim 9 further including the steps of:

a) cleaning the implanted surface; and then b) annealing the cleaned implanted surface prior to the step of conditioning.

13. The method of claim 12, wherein said step of annealing comprises heating the cleaned implanted surface to a temperature of less than 350° C. in a vacuum.

14. A method for preparing a diamond film having uniform electron emitting properties and a low turn-on voltage, comprising the steps of:

a) forming a nucleation layer on a substrate, the nucleation layer having a high number density of areas where crystal nucleation can take place;

b) depositing a polycrystalline diamond film onto the nucleation layer;

c) implanting carbon ions into the surface of the polycrystalline diamond film;

d) cleaning the implanted polycrystalline diamond film;

e) annealing the cleaned polycrystalline diamond film;

f) conditioning the annealed polycrystalline diamond film, by scanning the surface of the annealed polycrystalline diamond film with an electrode, wherein a constant positive voltage of at least about 500 V is applied between the electrode and the annealed, implanted surface of the polycrystalline diamond film and wherein the electrode is maintained at a constant distance of at least about 3 $\mu$m above the surface of the polycrystalline diamond film.

15. The method of claim 14, wherein a bias voltage of at least −200 V is applied to the substrate during the nucleation step.

16. The method of claim 14, wherein the substrate is a silicon wafer.

17. The method of claim 14, wherein the polycrystalline diamond film is at least 1 $\mu$m thick and is composed of diamond crystals about 200 nm wide.

18. The method of claim 14, wherein the carbon ions are implanted to a concentration of at least $10^{16}/cm^2$ at a beam current of about 80 $\mu$A.

19. The method of claim 14, wherein scanning comprises moving the electrode in incremental steps across the surface of the polycrystalline diamond film.

20. The method of claim 19, wherein the incremental steps are steps of about 20 $\mu$m.

* * * * *